US008081201B2

(12) United States Patent
Hirota

(10) Patent No.: US 8,081,201 B2
(45) Date of Patent: Dec. 20, 2011

(54) THERMAL TRANSFER PRINTER

(75) Inventor: Kenichi Hirota, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 1097 days.

(21) Appl. No.: 11/847,186

(22) Filed: Aug. 29, 2007

(65) Prior Publication Data

US 2008/0055387 A1 Mar. 6, 2008

(30) Foreign Application Priority Data

Aug. 31, 2006 (JP) ..... 2006-235970
Nov. 20, 2006 (JP) ..... 2006-313541
Nov. 20, 2006 (JP) ..... 2006-313550

(51) Int. Cl.
*B41J 17/28* (2006.01)
*B41J 17/30* (2006.01)
*B41J 33/14* (2006.01)

(52) U.S. Cl. ..... 347/217

(58) Field of Classification Search ..... 347/217, 347/216, 215, 171; 400/120.01, 237, 240.3, 400/248

See application file for complete search history.

(56) References Cited

FOREIGN PATENT DOCUMENTS

JP 3-190782 A 8/1991
JP 2005-297418 A 10/2005

*Primary Examiner* — Kristal Feggins
(74) *Attorney, Agent, or Firm* — Fitch, Even, Tabin & Flannery

(57) ABSTRACT

A thermal transfer printer according to the invention includes at least one printing unit for thermal transfer printing with a print head via a ribbon having a dye layer; a first bending member for bending the ribbon after thermal transfer, the first bending member having at least one curved surface that is aligned perpendicular to a conveyance direction of the ribbon and protrudes toward one or the other surface of the ribbon; a second bending member disposed at a distance from the first bending member, the second bending member having at least one acute apex that is aligned perpendicular to the conveyance direction of the ribbon and protrudes toward the one or the other surface of the ribbon, the apex causing a bend line to be formed in the used ribbon conveyed from the first bending member; a folder for folding the ribbon conveyed from the second bending member along the bend line; and a heater for fusing opposing dye layers of the folded ribbon together.

2 Claims, 12 Drawing Sheets

(a)

(b)

(c)

(a)

(b)

(c)

THERMAL TRANSFER PRINTER

This Application claims benefit from Japanese Patent Application No. 2006-235970 filed Aug. 31, 2006, Japanese Patent Application No. 2006-313541 filed Nov. 20, 2006 and Japanese Patent Application No. 2006-313550 filed Nov. 20, 2006, the complete disclosures of which are incorporated herein by reference.

BACKGROUND OF THE INVENTION

1. Field of the Invention

The present invention relates to a thermal transfer printer, and more particularly to a thermal transfer printer having an information leakage prevention means for preventing the leakage of recorded images remaining on a used ribbon.

2. Description of the Related Art

Used ribbons in dye-sublimation thermal transfer printers have recorded images remaining thereon, which poses a risk of information leakage from these remaining images. With printers for business use, in particular, ribbons that have been used by users are left inside the printers in stores. These used ribbons are simply mounted in the printers, so that the administrators of the printers have easy access to the used ribbons. If the used ribbons are thrown directly into trash bins, the recorded information may leak to ordinary people. It is therefore required that that used ribbons be provided with some means for preventing information leakage therefrom when they are removed from the printers.

In view of this, JP-A-3-190782 (Patent Document 1) and JP-A-2005-297418 (Patent Document 2), for example, propose thermal transfer printers with a mechanism for folding a used ribbon into a position such that the ink layers oppose each other, causing the opposing ink layers of the folded ribbon to be fused and fixed, and then winding the ribbon.

In order to form a bend line in used ribbons, the thermal transfer printer disclosed in Patent Document 1 uses a pressure roller, and the method disclosed in Patent Document 2 uses an angled guide member. In either case, however, great tension is applied to the bent portion of the used ribbon, thus making the ribbon easily breakable, and making printer maintenance difficult.

SUMMARY OF THE INVENTION

In order to overcome the aforementioned problems, there is provided, according to one aspect of the invention, a thermal transfer printer which comprises at least one printing unit for thermal transfer printing with a print head via a ribbon having a dye layer; a first bending member for bending the ribbon after thermal transfer, the first bending member having at least one curved surface that is aligned perpendicular to a conveyance direction of the ribbon and protrudes toward one or the other surface of the ribbon; a second bending member disposed at a distance from the first bending member, the second bending member having at least one acute apex that is aligned perpendicular to the conveyance direction of the ribbon and protrudes toward the one or the other surface of the ribbon, the apex causing a bend line to be formed in the used ribbon conveyed from the first bending member; a folder for folding the ribbon conveyed from the second bending member along the bend line; and a heater for fusing opposing dye layers of the folded ribbon together.

The printer according to the invention having this structure comprises the first bending member for bending the ribbon after thermal transfer and the second bending member that is disposed at a distance from the first bending member and has an apex with which a bend line is formed in the ribbon conveyed from the first bending member. This reduces tension generated in the ribbon during the formation of the bend line, thereby preventing the ribbon from breaking. A thermal transfer printer can thus be provided which has a function of preventing information leakage from used ribbons and is easy to maintain. The curved portion or the apex of the bending members may protrude in the direction of one surface (the top surface) or the other surface (the bottom surface) of the ribbon. That is to say, the direction in which the bending members protrude may correspond to the direction of the ribbon. For example, when the ribbon is positioned with one surface thereof facing upward, the bending members may be disposed to protrude upward or downward. Moreover, when the ribbon is positioned with one surface thereof facing in the horizontal direction, the bending members may be disposed to protrude in the horizontal direction.

The first bending member may, for example, have one curved surface that protrudes toward the one or the other surface of the ribbon, and the second bending member may, for example, have one acute apex that protrudes in the same direction as that of the curved surface of the first bending member, wherein the apex causes a bend line to be formed in the ribbon conveyed from the first bending member.

The second bending member may be disposed at a distance from the first bending member by a length corresponding to at least one-fourth of the width of the ribbon.

The first and second bending members may have a plurality of linear grooves formed in parallel with the conveyance direction of the ribbon on a surface thereof with which the ribbon comes into sliding contact.

The first bending member and the second bending member may be produced as a single molded product. Alternatively, the first bending member and the second bending member may be separate, and a base may further be provided on which both of the bending members are integrally fixed.

The folder and the heater according to the invention may be separately provided or may be formed integrally. For example, the folder and the heater may be formed of a pair of rollers for folding the ribbon, and at least one of the rollers may be capable of heating the ribbon.

The printing unit may effect printing with the print head by conveying the ribbon downstream, while moving in a direction opposite to the conveyance direction during printing, and a distance between the second bending member and the heater may be set to be longer than a distance of movement of the ribbon during printing.

The printing unit may effect printing with the print head by conveying the ribbon downstream, while moving in a direction opposite to the conveyance direction during printing, and a portion of the ribbon that passes by the heater while the ribbon is conveyed downstream may not be heated by the heater within a distance of movement during printing that starts from an upstream end of the portion.

The heater may be capable of moving toward or away from the ribbon.

The heater may also have a low-capacity heat source.

The heater may generate electromagnetic waves.

A buffer unit may further be provided between the printing unit and the first bending member to adjust the length of the ribbon to be conveyed after thermal transfer.

The buffer unit may comprise a plurality of adjustment rollers disposed above and below the ribbon, and spaced in the conveyance direction, wherein each of the adjustment rollers may be capable of moving toward and away from the ribbon.

Alternatively, the buffer unit may include a pair of first conveying rollers which convey the ribbon downstream while holding it from both sides, and a pair of second conveying rollers which are positioned upstream of the pair of first conveying rollers, and convey the ribbon downstream while holding it from both sides.

According to another aspect of the invention, there is provided a thermal transfer printer comprising two or more printing units for thermal transfer printing with a print head via a ribbon having a dye layer; buffer units each positioned downstream of each of the printing units to adjust the length of the ribbon to be conveyed after thermal transfer; a laminating means for laminating the plurality of ribbons that have passed by their respective buffer units; and a heater for heating the laminated ribbons.

According to still another aspect of the invention, there is provided a thermal transfer printer which comprises at least one printing unit for thermal transfer printing with a print head via a ribbon having a dye layer; a width-reducing member for guiding the ribbon after thermal transfer downstream, while causing the ribbon to shrink in the width direction; a heater disposed downstream of the width-reducing member for heating the ribbon; and a take-up roll for winding the ribbon that has passed by the heater; wherein the printing unit effects printing with the print head by moving the ribbon in a direction opposite to a downstream conveyance direction during printing; and a distance between the width-reducing member and the heater is set to be longer than a distance of movement of the ribbon during printing.

According to yet another aspect of the invention, there is provided a thermal transfer printer which comprises at least one printing unit for thermal transfer printing with a print head via a ribbon having a dye layer; a width-reducing member for guiding the ribbon after thermal transfer downstream, while causing the ribbon to shrink in the width direction; a heater disposed downstream of the width-reducing member for heating the ribbon; and a take-up roll for winding the ribbon that has passed by the heater; wherein the printing unit effects printing with the print head by moving the ribbon in a direction opposite to a downstream conveyance direction during printing; and a portion of the ribbon that passes by the heater while the ribbon is conveyed downstream is not heated by the heater within a distance of movement during printing that starts from an upstream end of the portion.

BEST MODE FOR CARRYING OUT THE INVENTION

Figure 1:
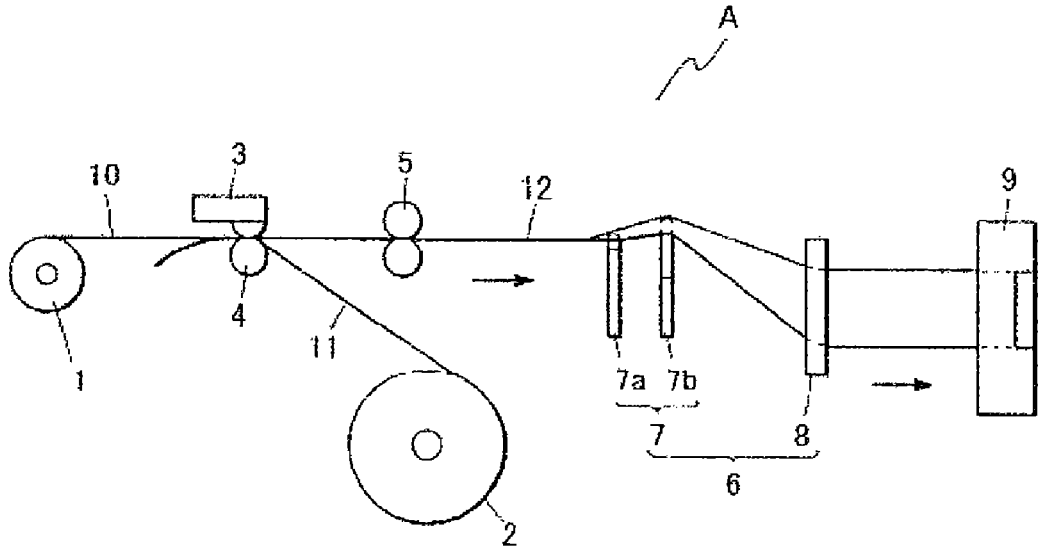
FIG. 1 is a schematic diagram showing an example of the structure of principal parts of a thermal transfer printer according to one embodiment of the invention.
Figure 2:
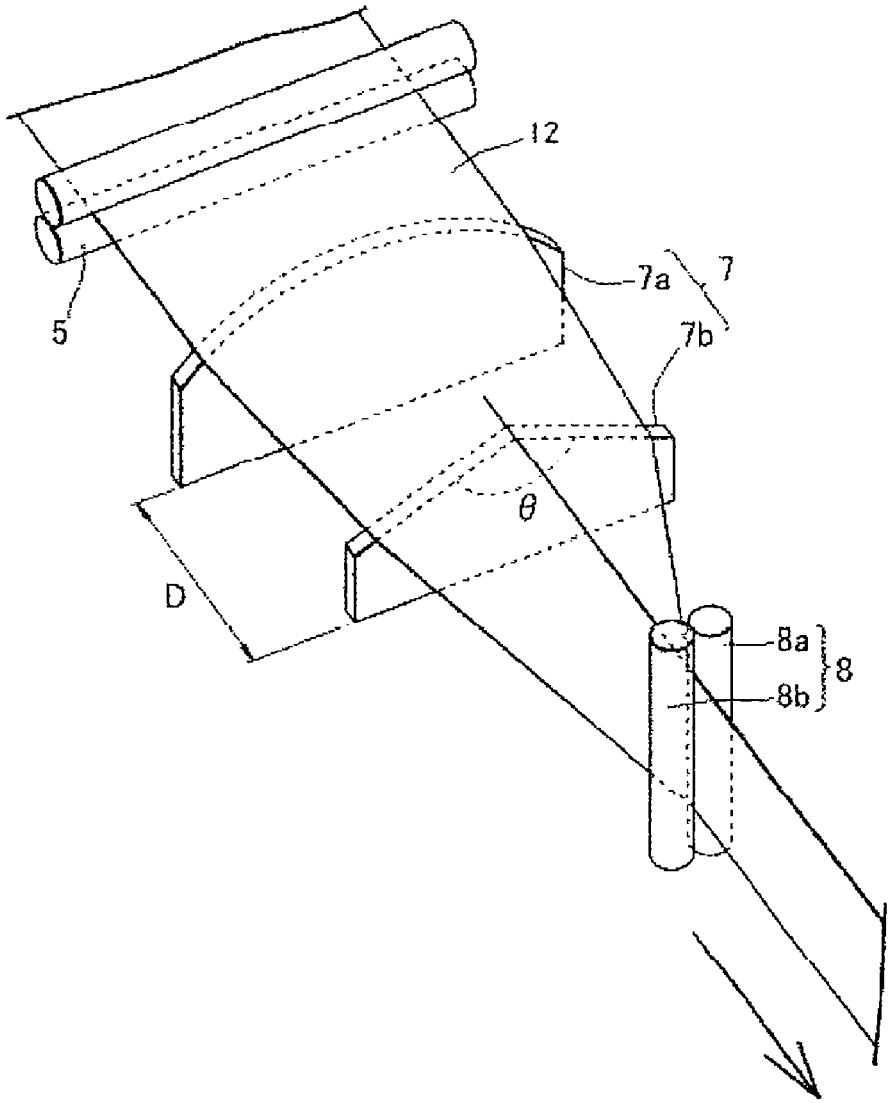
FIG. 2 is a schematic diagram showing an example of the structure of a used ribbon processing mechanism of a thermal transfer printer according to one embodiment of the invention.

An embodiment of the invention will be described below with reference to the drawings. FIG. 1 is a schematic diagram showing an example of the structure of principal parts of a thermal transfer printer A according to the embodiment. FIG. 2 is a schematic diagram showing an example of the structure of a used ribbon processing mechanism.

In FIG. 1, a ribbon supply roll 1 wound with a ribbon 10 and a receiver sheet supply roll 2 wound with a receiver sheet 11 are provided in the thermal transfer printer. Along the conveyance path between the ribbon 10 and the receiver sheet 11 are disposed a platen roll 4 and a thermal head (print head) 3 which constitute a printing unit. The ribbon 10 and the receiver sheet 11 pass between the platen roll 4 and the thermal head 3 while pressing against each other. The used ribbon 12 that has passed by the thermal head 3 is conveyed by conveying rollers 5 to a used ribbon processing mechanism 6, and then wound onto a take-up roll 9. The used ribbon processing mechanism 6 has a bending unit 7 and a heating unit 8. As shown in detail in FIG. 2, the bending unit 7 has a first bending member 7*a* situated closer to the thermal head and a second bending member 7*b* situated at a distance from the first bending member, each of which is supported by a support member (not illustrated).

The operation of the thermal transfer printer will now be described. In an initial state before printing, the thermal head 3 is lifted and separated from the platen roll 4. When the ribbon supply roll 1 is mounted, the edge of the ribbon 10 is passed between the conveying rollers 5. The edge of the ribbon 10 is then passed between a heat roller 8*a* and a pressure roller 8*b* that constitute a heating unit 8, while covering the top of the bending unit 7. The edge of the ribbon 10 is then fixed around the take-up roll 9. The edge of the receiver sheet 11, on the other hand, is drawn from the receiver sheet supply roll 2, and held between conveying rollers (not illustrated) and fixed.

During printing, the thermal head 3 is lowered by a pressing mechanism (not illustrated) to press the ribbon 10 and the receiver sheet 11 together between the thermal head 3 and platen roll 4. The thermal head 3 with a plurality of heat resistors then records on the receiver sheet 11 by selectively heating the sheet according to image information on the thermal head 3.

When printing is completed, the pressing mechanism (not illustrated) lifts the thermal head 3, whereupon the pressure between the ribbon 10 and the receiver sheet 11 is released. A predetermined length of the receiver sheet 11 is drawn by conveying rollers (not illustrated), and conveyed to an ejector (not illustrated). The used ribbon 12, on the other hand, is conveyed by the conveying rollers 5 to the processing mechanism 6. The bending unit 7 forms a bend line in the ribbon 12 delivered to the processing mechanism 6, and then the ribbon 12 is delivered to the heating unit 8. In the bending unit 7, the first bending member 7*a* causes the ribbon 12 to curve upwardly, and then the second bending member 7*b* with an acute apex forms a bend line in the used ribbon 12 in the longitudinal direction. The ribbon 12 with a bend line is passed between the heat roller 8*a* and pressure roller 8*b*, and is thereby folded along the bend line, which causes the opposing dye layers to be fused together. The used ribbon 12 that has passed through the processing mechanism 6 is subsequently wound onto the take-up roll 9.

The first bending member 7*a* is a plate material whose upper edge has an arch-shaped curved surface. Contacting the ribbon 12 with this arch portion allows the ribbon to curve upwardly. This reduces the tension that is generated when the bend line is formed by the second bending member 7*b*. The second bending member 7*b* may be composed of a plate material with an acute apex in the center, and more specifically, a plate material with an isosceles triangle-shaped top. The vertical angle θ of the isosceles triangle is preferably from 90 to 150°. This is because an angle of less than 90° produces great tension, whereas an angle of more than 150° makes it difficult to form a bend line. Note that the apex of the second bending member 7*b* may not necessarily have an acute edge, as long as it is acute enough to form a bend line.

While typical plastic materials such as ABS and styrene are usable as the first and second bending members 7*a*, 7*b*, materials such as silicone-modified resin are particularly preferable because they can reduce the frictional resistance between these members and the ribbon.

Figure 3:
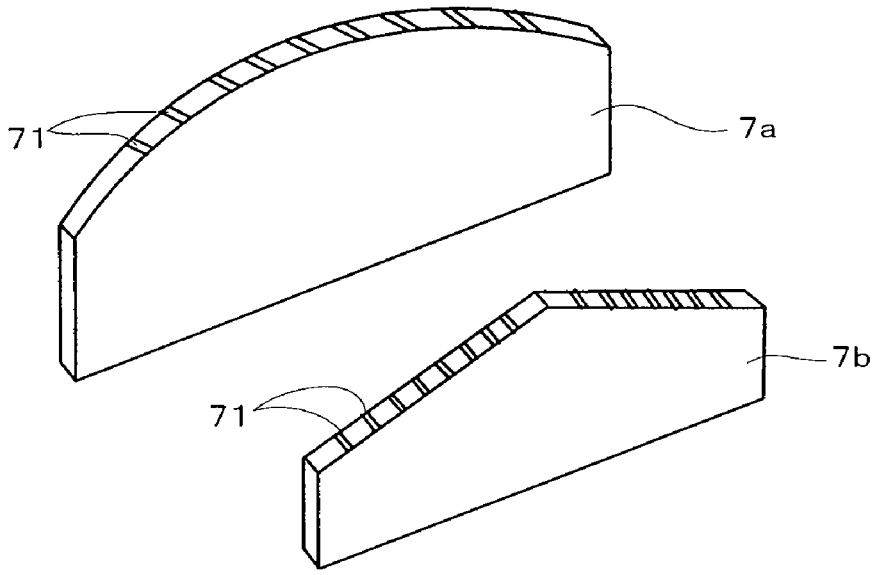
FIG. 3 is a perspective view showing another example of each of the first and second bending members.

Further, as shown in FIG. 3, the upper surfaces of the first and second bending members 7*a*, 7*b*, with which the used ribbon comes into sliding contact, preferably have a plurality of linear grooves 71 formed in parallel to the conveyance direction of the ribbon. This further reduces the tension by reducing the frictional resistance between these members and the ribbon. Note that such grooves may be formed not in both of, but only in one of the bending members 7*a*, 7*b*.

The second bending member 7*b* is positioned at a distance from the first bending member 7*a*. This distance D is at least 1/4, and preferably not less than 1/4 and not more than 1/1, of the width of the used ribbon. If the distance D is shorter than the width of the used ribbon, the used ribbon cannot be curved sufficiently with the first bending member 7*a*, and the effect of reducing the tension cannot be obtained.

Figure 4:
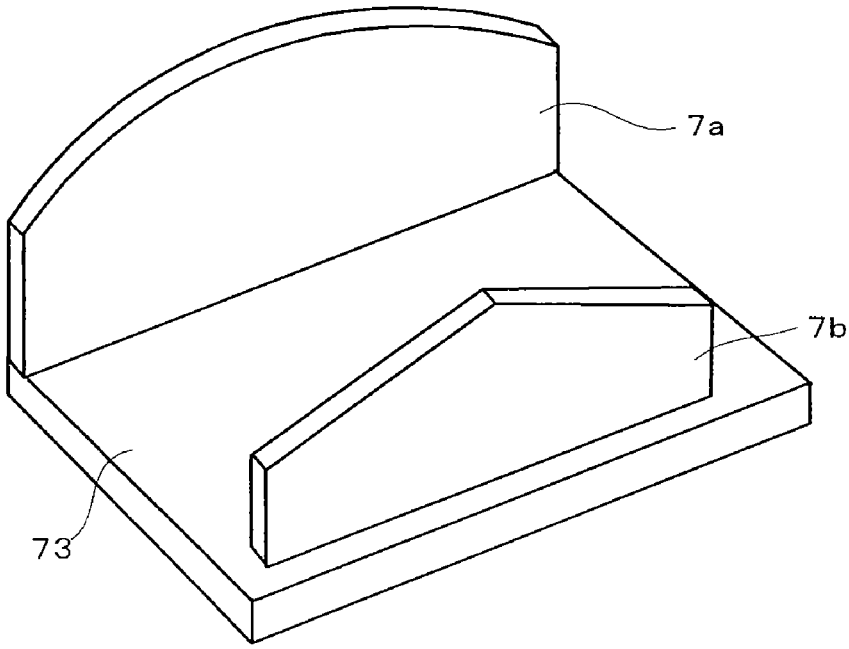
FIG. 4 is a perspective view showing still another example of each of the first and second bending members.

Although the figures show an example of the structure in which the first bending member 7*a* and the second bending member 7*b* are separate, a bending unit in which the first bending member 7*a* and the second bending member 7*b* form a single molded product may also be used. Moreover, when the first bending member 7*a* and the second bending member 7*b* are separate, as shown in FIG. 4, they can be integrally fixed to a base 73.

In order to thermally fuse the dye layers together, the temperature of the heat roller 8*a* must be equal to or higher than the glass transition temperature of the binder resin contained in the dye layers. The temperature is, for example, from 100 to 200° C., and preferably from 110 to 180° C.

Figure 5:
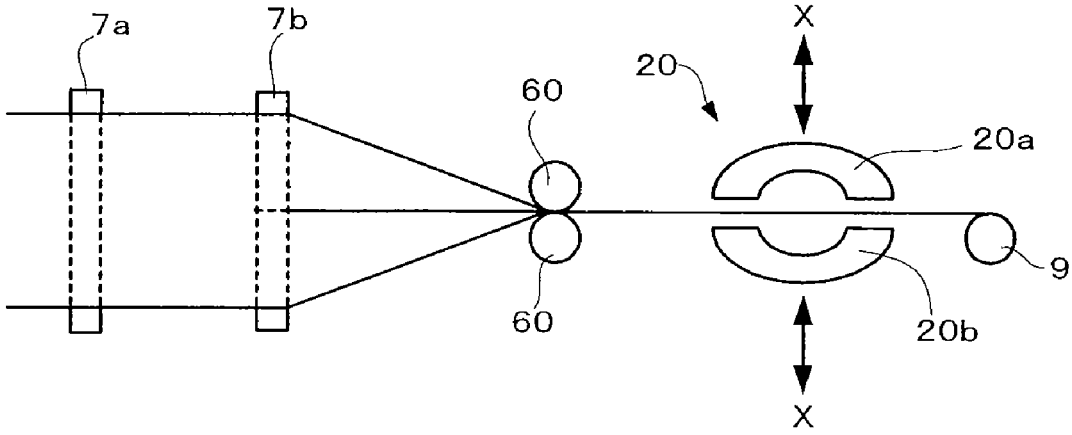
FIG. 5 is a plan view showing a portion of another example of the thermal transfer printer of FIG. 1.

In the above-described embodiment, the heating unit performs both heating and folding of the ribbon. That is to say, the folder and the heater according to the invention are formed integrally. These components, however, may also be separate, for example, as shown in FIG. 5. FIG. 5 is a plan view showing a portion of such a thermal transfer printer. As shown in FIG. 5, in this example, a pair of folding rolls 60 for folding a ribbon are positioned downstream of the second folding member 7*b*, and the folded ribbon is passed between these rolls 60. Downstream of the folding rolls 60 is disposed a heater 20 for heating the folded ribbon. The heater 20 is composed of a pair of heating members 20*a*, 20*b* disposed so that the ribbon is positioned therebetween. Each of the heating members 20*a*, 20*b* applies heat sufficient to soften the resin contained in the dye layers of the ribbon (100 to 120° C.), or applies heat sufficient to soften the ribbon, including the ribbon base (150 to 220° C.). While the heater shown in FIG. 5 heats the ribbon at a distance therefrom, for example, by using a far-infrared lamp, it may also have a low-capacity heat source such as a thermal head, so as to avoid the application of excess heat.

The term "low-capacity heat source" as used herein denotes a heating member in which the heat source has a very low heat capacity, and the temperature of the heat source after the supply of heat to the heat source is stopped rapidly decreases to 30 to 50° C. The definition of a "very low heat capacity" denotes a heat capacity such that the amount of heat remaining in the heat source immediately after heating has been stopped is so small that even if the heat is applied intensively to one area of a ribbon that has stopped being conveyed, the film used as the ribbon base, such as PET, is not heated to its melting point (around 250° C.), thereby preventing the ribbon from breaking due to excess heating. While the state described by "the supply of heat to the heat source is stopped" may depend on the heating element selected, in the case of a thermal head, this denotes a state in which the application of electricity is stopped. The term "rapidly" is defined as a period of about one second.

Alternatively, the heating members 20*a*, 20*b* may generate electromagnetic waves such as microwaves, so as to heat only the dye layers of the ribbon without heating other portions that do not require heating.

Note that the ribbon is not continuously conveyed, but stops, for example, at the instance before and after printing, as described below. In such an instance, excess heat is applied to the ribbon that is being exposed to heat by the heater 20, possibly breaking the ribbon. For this reason, as shown in FIG. 5, the heating members 20*a*, 20*b* may move toward or away from the ribbon, and move away from the ribbon (as indicated by the arrows X) when the ribbon has stopped advancing.

Figure 6:
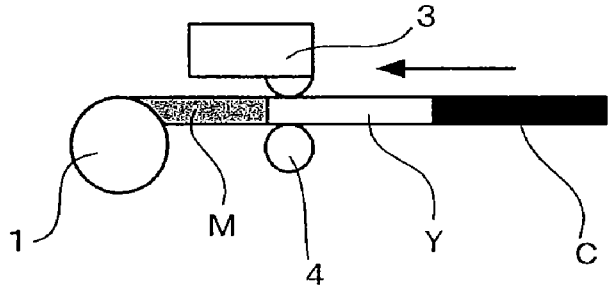
FIGS. 6 (*a*), (*b*) and (*c*) are diagrams for use in describing the motion of a ribbon during color printing.
Figure 6:
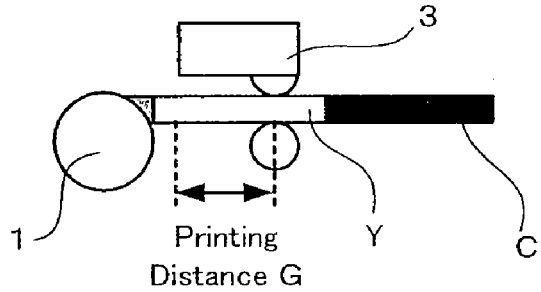
Figure 6:
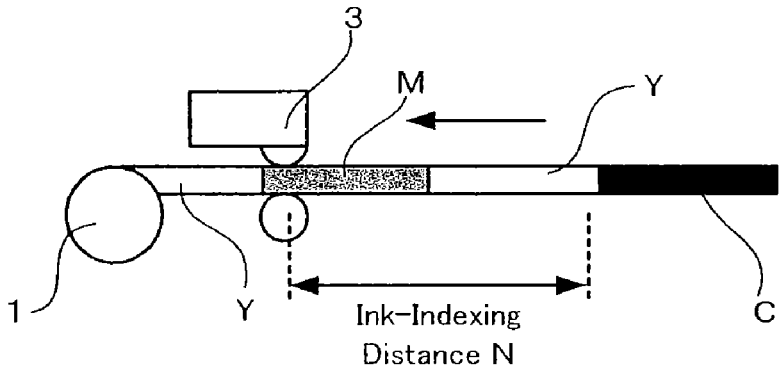

In the case of color printing, a ribbon is typically used which has repeated coatings of dye layers of cyan C, magenta M and yellow Y formed sequentially in the longitudinal direction of the base. These dye layers are sequentially printed and superimposed onto the receiver sheet. During color printing, when the receiver sheet is returned to its initial position by the supply roll 2 every time a single color is printed thereon, the receiver sheet is conveyed after all of the dyes have been superimposed. The ribbon is also positioned upstream of each ink every time a single color is printed. For example, when yellow Y is printed, the thermal head 3 is positioned on the upstream end of yellow Y, as shown in FIG. 6 (*a*). The ribbon is then pressed between the thermal head 3 and the platen roll 4, while being rewound with the supply roll 1, thereby printing yellow Y. When the thermal head 2 is positioned on the downstream end of yellow Y, as shown in FIG. 6 (*b*), printing of yellow Y is completed. That is to say, the ribbon is rewound for the distance G while a single ink is printed. In this time period, the ink is printed on the receiver sheet. Upon completion of printing yellow Y, the ribbon is conveyed downstream for a predetermined distance N. The thermal head 3 is then positioned on the upstream end of magenta M, as shown in FIG. 6 (*c*), to prepare for printing magenta M. Yellow Y, magenta M and cyan C are sequentially superimposed onto the receiver sheet by repeating these procedures, thus resulting in the formation of an image.

Figure 7:
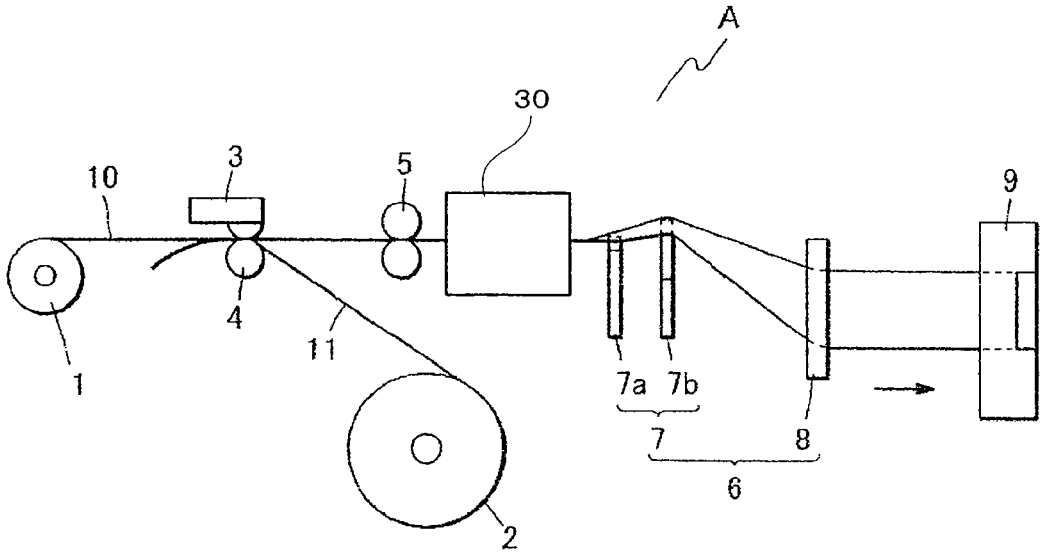
FIG. 7 is a front view showing an example of a thermal transfer printer comprising a buffer unit.

During this color printing, the ribbon moves in the direction opposite to the conveyance direction, causing a great load to be applied to the ribbon that is being bent by the bending unit 7, thus possibly breaking the ribbon. In order to prevent this, a buffer unit 30 may be provided, as shown in FIG. 7, between the printed area and the first bending member 7*a* to adjust the length of the ribbon to be conveyed.

Figure 8:
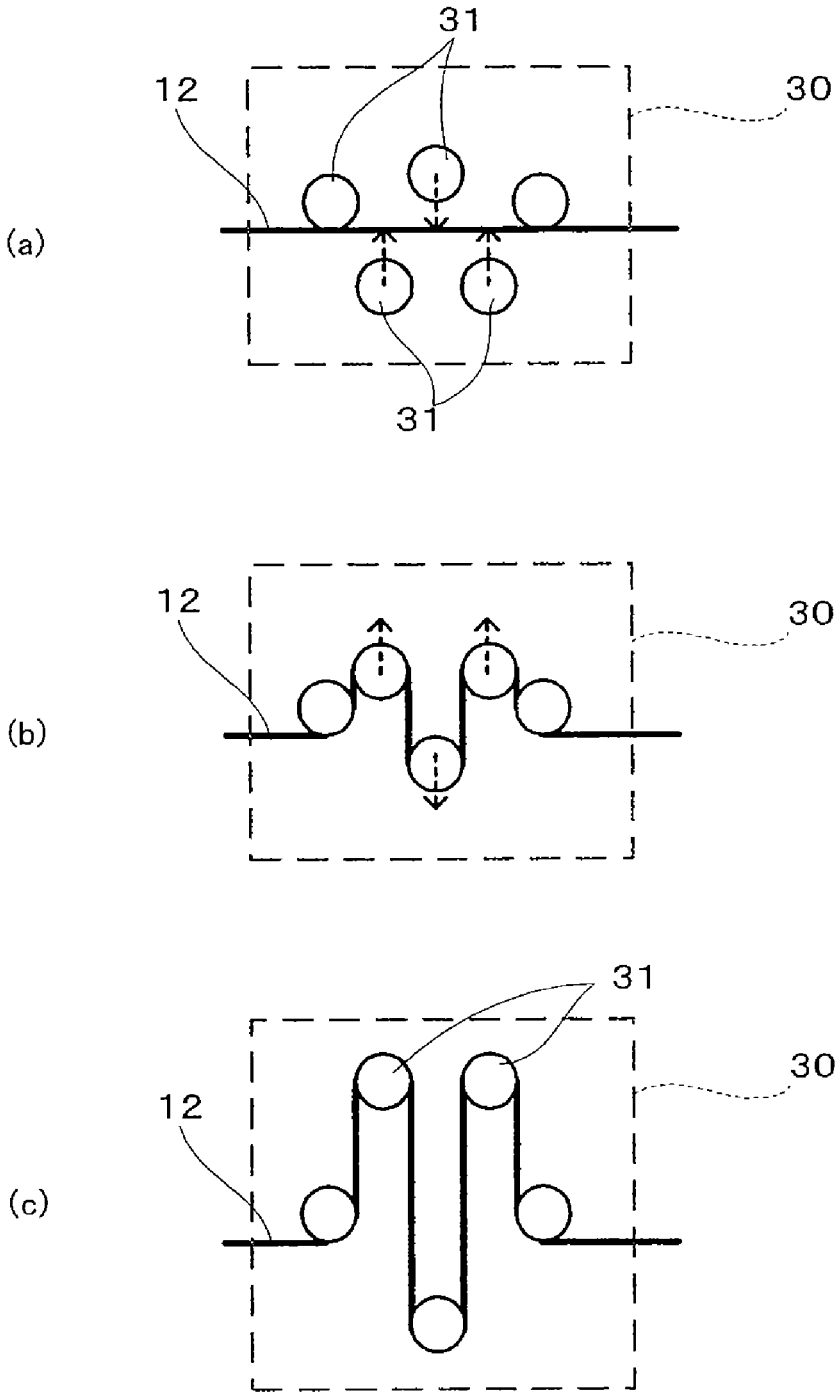
FIGS. 8 (*a*), (*b*) and (*c*) are front views showing an example of the buffer unit.

The buffer unit is illustrated in detail in FIG. 8. FIGS. 8 (*a*), (*b*) and (*c*) are each front views for use in describing the structure and operation of the buffer unit. As shown in FIG. 8 (*a*), the buffer unit 30 has five adjustment rollers disposed above and below the used ribbon 12, and spaced in the conveyance direction. In this example, three adjustment rollers 31 are disposed on the upper-surface side of the ribbon 12, and two rollers 31 are disposed on the lower-surface side thereof. Each adjustment roller 31 is capable of moving toward and away from the ribbon 12. For example, as shown in FIGS. 8 (*b*) and (*c*), the three adjustment rollers 31 in the center approach the ribbon 12, pull the ribbon, and move while maintaining contact with the ribbon, thereby adjusting the length of the path of the ribbon 12 within the buffer unit 30 according to the amount of their movement. This allows the length of the ribbon to be conveyed downstream of the buffer unit 30 to be adjusted. As a result, the movement of the ribbon opposite to the conveyance direction during printing does not affect the ribbon downstream of the buffer unit 30. Such a buffer unit can also be used for purposes other than color printing, for example, to adjust the conveyance speed of the ribbon between the printed area and the bending unit.

Figure 9:
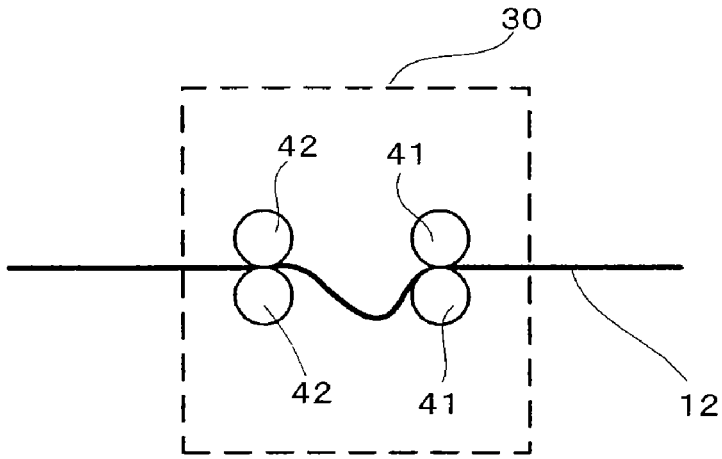
FIG. 9 is a front view showing another example of the buffer unit.

The buffer unit may also have a structure such as that shown in FIG. 9. FIG. 9 is a front view showing another structure of the buffer unit. As shown in FIG. 9, the buffer unit may include a pair of downstream conveying rollers 41, which convey the ribbon 12 downstream while holding it from both sides, and a pair of upstream conveying rollers 42, which are positioned upstream of the downstream conveying rollers 41, and convey the ribbon 12 downstream while holding it from both sides. With this structure, the conveyance speed of the ribbon 12 upstream and downstream of the buffer unit 30 can be varied by adjusting the conveyance speeds of both the conveying rollers 41, 42. For example, when the conveyance speed of the downstream conveying rollers 41 is made slower than that of the upstream conveying roller 42, the ribbon 12 downstream of the buffer unit 12 can be conveyed at a slower speed than that during printing, thereby adjusting the length of the ribbon to be conveyed downstream.

While the use of the first bending member 7*a* with one curved portion and the second bending member 7*b* with one apex has been shown as an example in the above-described embodiment, first and second bending members 7*a*, 7*b* with a plurality of curved portions or apexes can also be used. In that case, multiple bend lines which are not limited to two, such as three, four, etc., can be formed in a ribbon. Examples of such bending units will be described below.

Figure 10:
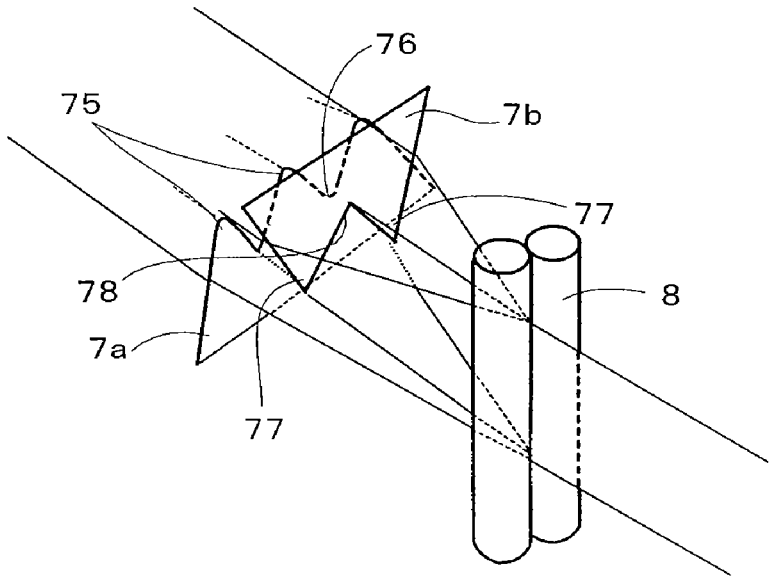
FIG. 10 is a perspective view showing an example of a bending unit.

As shown in FIG. 10, in this example, the upper end of the first bending member 7*a* is formed in a wavelike pattern. More specifically, the first bending member 7*a* has three upwardly protruding peaks 75 each with a curved tip and two troughs 76 each with a curved bottom. This causes five curves to be formed on the ribbon that passes through the first bending member 7*a*. The lower end of the second bending member 7*b* positioned downstream of the first bending member 7*a* has two acute downwardly protruding apexes 77 formed in a row. The trough 78 between these peaks 77 is acute. Thus, when the curve of the ribbon formed along the trough 75 of the first bending member 7*a* passes by the peaks 77 of the second bending member 7*b*, folds are formed on the curve. Moreover, when the curves of the ribbon formed after passing by the central peak 75 of the first bending member 7*a* passes by the trough 76 of the second bending member 7*b*, folds are formed on the curve. Five folds are thus formed on the ribbon, and then the ribbon passes by the heating unit 8 and is thereby folded, simultaneously causing the dye surfaces to be fused together.

Figure 11:
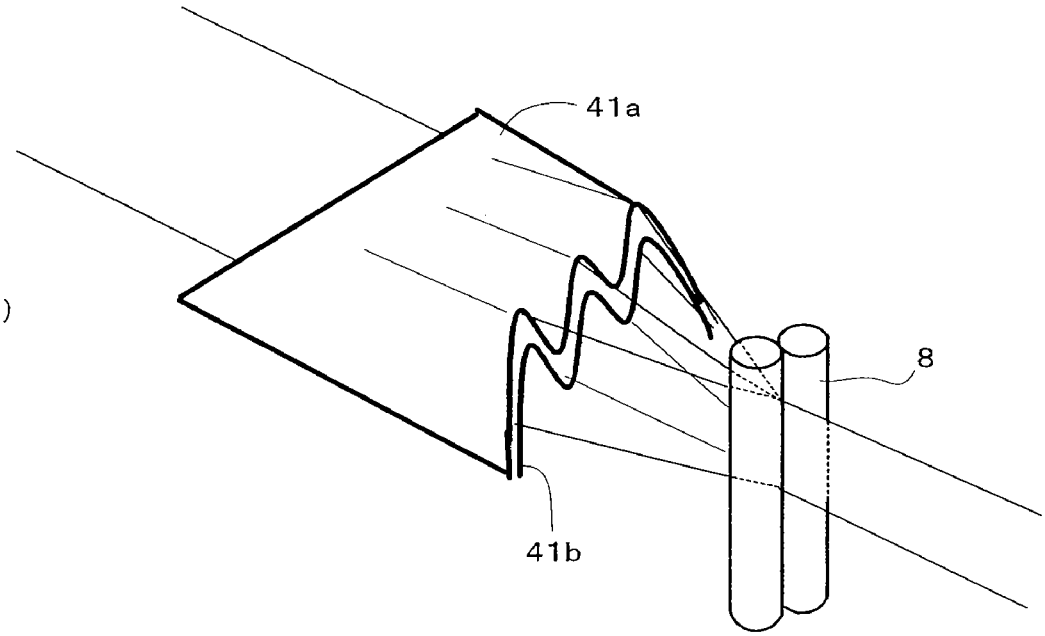
FIGS. 11 (*a*), (*b*) and (*c*) are a perspective view and cross sections, respectively, showing another example of the bending unit.
Figure 11:
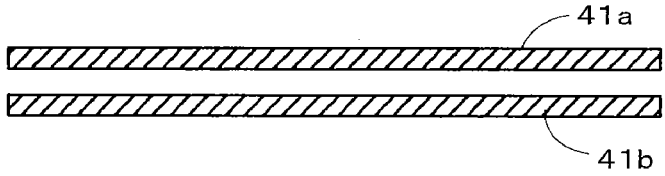
Figure 11:
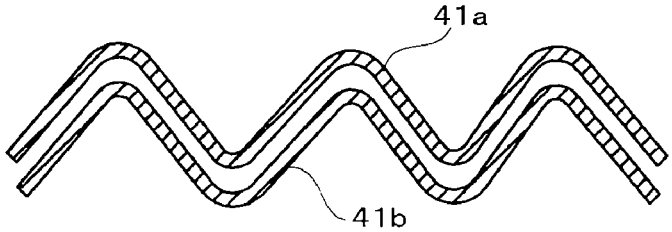

The bending unit may also have a structure as shown in FIG. 11. In this example, as shown in FIG. 11 (*a*), two sheets of plates 41*a*, 41*b*, positioned vertically at a predetermined distance from each other, are provided so that a ribbon can pass between the plates. The upstream side of the plates 41*a*, 41*b* is formed in a flat shape as shown in FIG. 11 (*b*), while the downstream side thereof is formed in a wave-like pattern as shown in FIG. 11 (*c*). The flat plates 41*a*, 41*b*, as they approach the downstream, begin to protrude vertically to form a plurality of curves in the direction perpendicular to the conveyance direction. The downstream wave pattern is formed of three upwardly protruding projections and two downwardly protruding projections. With this structure, five folds are formed on the ribbon that passes between the plates 41*a*, 41*b* while the ribbon is conveyed. The ribbon then passes by the heating unit 8 and is thereby folded, causing the dye surfaces to be fused together.

Figure 12:
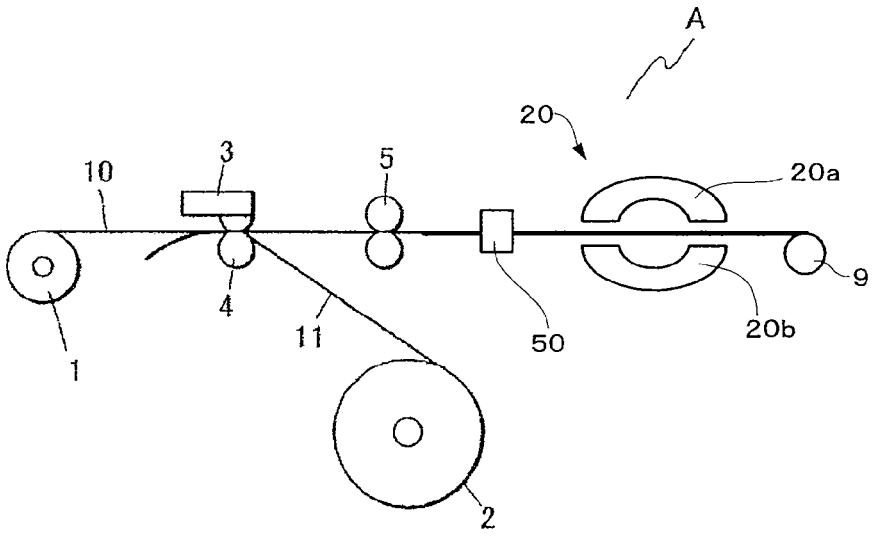
FIG. 12 is a front view showing another example of the thermal transfer printer of FIG. 1.

In the aforementioned examples, the ribbon is folded with the first and second folding members and subsequently heated; however, the ribbon may be bound in the width direction instead of being folded, so as to become unreadable. Such an example is now described referring to FIG. 12. In this example, as shown in FIG. 12, a ring (a width-reducing member) 50 for binding a ribbon in the width direction, a heater 20 and a take-up roll 9 are sequentially arranged downstream of the conveying rollers 5. The ring 50 has an inner diameter smaller than the width of the ribbon, and penetrates from its upstream side through its downstream side. The ribbon conveyed from the conveying rollers 5, while being bound with the ring 50 in the width direction, is thus guided downstream, heated by the heater 20, and then wound onto the take-up roll 9. The heater 20 has the same structure as that described above.

With this structure, the ribbon is bound in the width direction and then heated, which causes the dye surfaces to be fused together, thereby preventing the reading of information from the ribbon. While the ring 50 is used for binding the ribbon in this example, any suitable member capable of reducing the width of the ribbon can be used, such as a U-shaped member. Moreover, while the ribbon is bound with the ring 50 and then heated in this example, this order of steps may be the opposite. That is to say, the ribbon may be heated and softened, and then bound with the ring 50.

Note that the take-up roll 9 can be made to reciprocate in the axial direction (i.e., the direction vertical to the paper of FIG. 12). Because the ribbon that has passed through the ring 50 is bound and has a narrow width, the ribbon can be evenly wound around the take-up roll 9 by causing the take-up roll 9 to reciprocate in the axial direction.

Figure 13:
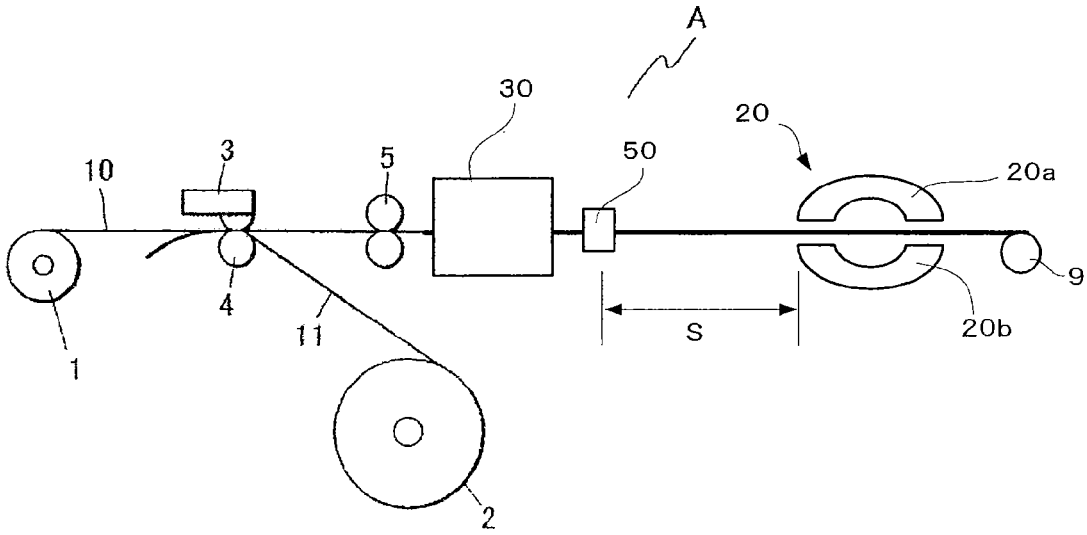
FIG. 13 is a front view showing another example of the thermal transfer printer of FIG. 1.

Moreover, in the case of color printing with a printer that uses such a ring 50, the ribbon may be conveyed upstream during printing. In this case, as shown in FIG. 13, a buffer unit 30 as described above may be provided between the conveying rollers 5 and the ring 50, and the distance S between the ring 50 and the heater 20 may be set to be longer than the rewinding distance G of the ribbon (see FIG. 6). With this structure, because the ribbon is rewound in the direction opposite to the direction in which the ribbon is unwound during printing, the ribbon that has shrunk in the width direction is rewound in the opposite direction; however, because the distance S between the ring 50 and the heater 20 is set to be longer than the rewinding distance G during printing, the portion of the ribbon that has shrunk in the width direction and has been heated does not pass through the ring 50 again. This prevents the ribbon from breaking.

Figure 14:
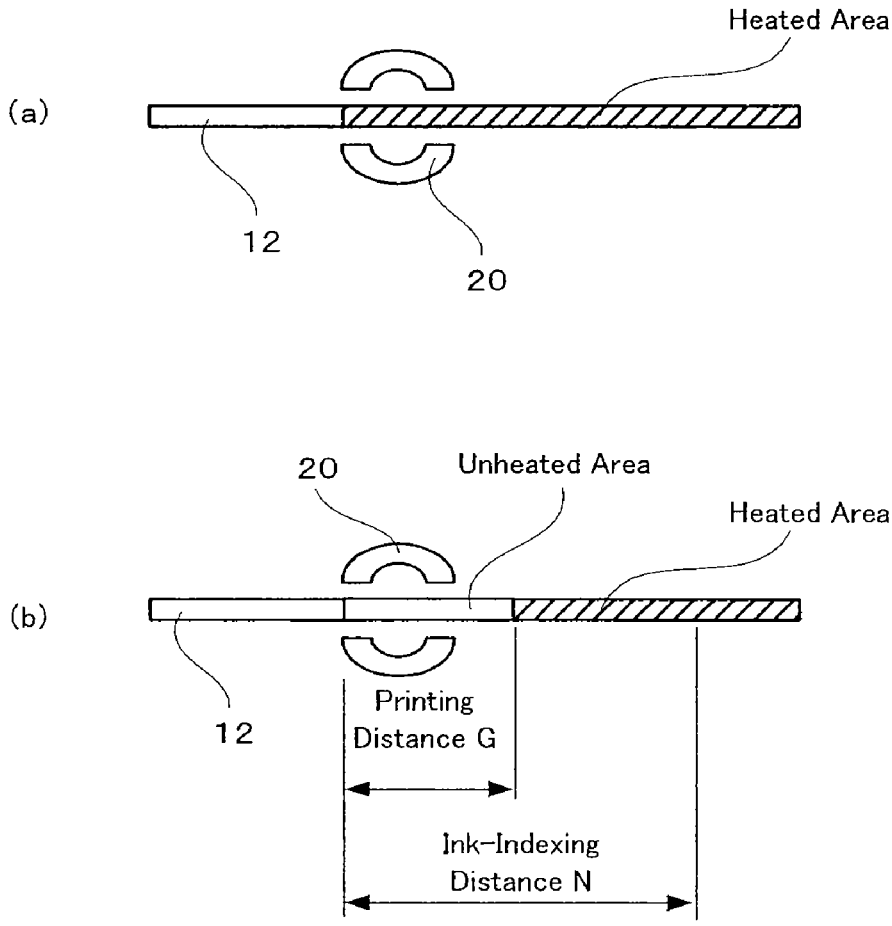
FIG. 14 is a diagram showing the area of a ribbon heated by a heating unit.

Moreover, the following structure is also possible. The portion of the ribbon that passes by the heater 20 while the ribbon is unwound is designed not to be heated by the heater 20 within the rewinding distance G that starts from its downstream end. As shown in FIG. 14 (*a*), all of the ribbon that has passed by the heater 20 is heated; however, as shown in FIG. 14 (*b*), the portion of the ribbon that has passed by the heater 20 for indexing the start of the ink is designed not to be heated within the printing distance G that starts from the upstream end thereof. This prevents breakage of the ribbon 12 regardless of the distance between the ring 50 and the heater 20. More specifically, when the ribbon 12 is rewound, even if the rewound portion of the ribbon 12 passes through the ring 50 in the opposite direction, this portion is not heated and can thus be widened in the width direction. Therefore, even when the ribbon 12 is rewound during printing, damage to the ribbon can be prevented. In this case, in order to provide an unheated area of the ribbon, the heater 20 may be positioned at a distance from the ribbon 12, for example, as shown in FIG. 5, so as to refrain from heating.

Figure 15:
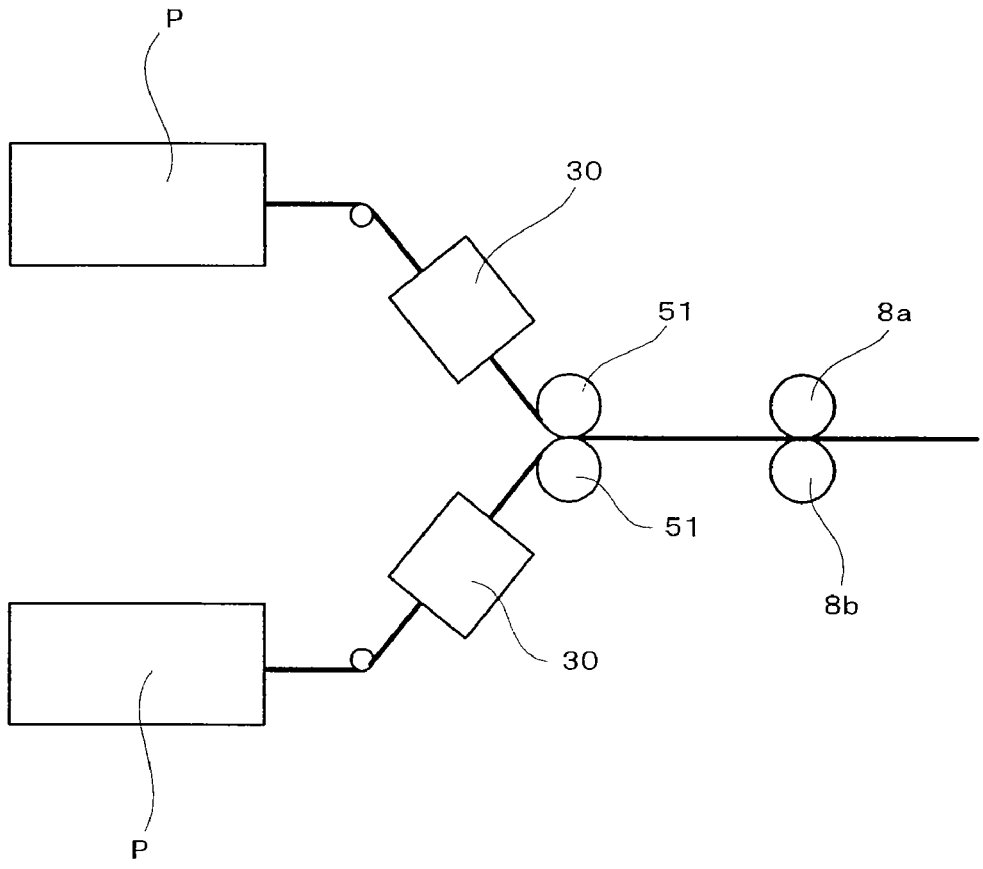
FIG. 15 is a front view showing yet another example of the thermal transfer printer of FIG. 1.

Furthermore, the thermal transfer printer may also have a structure as shown in FIG. 15 to prevent ribbons from being read. As shown in FIG. 15, the thermal transfer printer comprises two printing units P for thermal transfer printing with a thermal head as described above. The ribbons that have been unwound from both the printing units P after thermal transfer pass by their respective buffer units 30 which adjust the lengths of these ribbons to be conveyed, and then pass between a pair of junction rollers (laminating means) 51, so that their dye layers are laminated with each other. Downstream of the junction rollers 51 are disposed a heat roller (heater) 8*a* and a pressure roller 8*b*. The structure of each of the buffer unit 30, heat roller 8*a* and pressure roller 8*b* is the same as that described above. With this structure, the ribbons which are conveyed from the plurality of printing units P after thermal transfer are laminated and then heated, so that their dye surfaces adhere to each other to bond the two ribbons. As a result, recorded images remaining on the ribbon R can be rendered illegible. In this apparatus, in particular, the length of each ribbon to be conveyed can be adjusted by the corresponding buffer unit 30 between the printing unit P and the junction rollers 51 downstream of the printing unit. Thus, even if the ribbon conveyance speed is different between the two printing units P, such a difference in speed can be adjusted by the buffer units 30 to thereby obviate inconvenience in printing.

The ribbon is not particularly limited as long as it has a dye layer on one surface of its base, but preferably has a bottom-surface layer on the other surface thereof. The base of a thermal transfer sheet may be any known material with a certain degree of heat resistance and strength. Examples of materials include polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellophane, cellulose derivatives such as cellulose acetate, polyethylene films, polyvinyl chloride films, nylon films, polyimide films, ionomer films and the like. Among these examples, polyethylene terephthalate films are preferable. The thickness of the material used is about 0.5 to about 5.0 μm, and preferably about 1 to about 10 μm.

A dye layer may be formed of a single monochrome layer, or a plurality of dye layers with different phases of colors may be repeatedly formed sequentially on the same surface of the same base. Dye layers support a sublimable color on an optional binder. Dyes used in known dye-sublimation transfer sheets, which are thermally melt, diffused or transferred by sublimation, may be used in the invention. These dyes can be selected in consideration of their color phase, printing density, light resistance, shelf life, solubility in binders and the like.

Examples of dyes include diarylmethine, triarylmethine, thiazoles, methines such as merocyanine and pyrazolone methine, azomethines such as indoaniline, acetophenoneazomethine, pyrazoloazomethine, imidazoleazomethine, imidazoazomethine and pyridoneazomethine, xanthenes, oxazines, cyanomethylenes such as dicyanostyrene and tricyanostyrene, thiazines, azines, acridines, benzeneazos, azos such as pyridone azo, thiophene azo, isothiazole azo, pyrrole azo, pyrazolo azo, imidazol azo, thiadiazole azo, triazole azo and disazo, spiropyrans, indolino spiropyrans, fluorans, rhodamine lactams, naphthoquinones, anthraquinones, quinophthalones and the like.

Any known binder resin may be used as a binder for the dye layer. Preferable examples of such binders include cellulose resins such as ethyl cellulose, hydroxyethylcellulose, ethylhydroxycellulose, hydroxypropylcellulose, methylcellulose, cellulose acetate and cellulose butyrate, vinyl resins such as polyvinyl alcohol, polyvinyl acetate, polyvinyl butyral, polyvinyl acetal, polyvinyl pyrrolidone and polyacrylamide, polyester resin, phenoxy resin and the like. Especially preferable among these examples are cellulose resins, acetal resins, polyvinyl butyral resins, polyester resins and phenoxy resins, in view of their good heat resistance, dye transferability and the like.

A dye layer may incorporate any of the aforementioned dyes, binders, and various known additives, as necessary. Examples of additives include organic particles such as polyethylene wax, inorganic particles, silicone oil and phosphoric ester, for improving the releasability from receiver sheets and the suitability of inks for application. Such a dye layer can be typically formed by adding any of the aforementioned dyes, binders and optional additive(s) to a suitable solvent, dissolving or dispersing these components to prepare a coating dispersion, and then applying the resulting dispersion onto a base and drying. Coating can be accomplished by a known means, such as gravure printing, screen printing, or reverse roll coating using a gravure plate. The amount of the thus formed dye layer is from 0.2 to 6.0 g/m$^2$, and preferably from 0.2 to 3.0 g/m$^2$, as measured after drying.

A heat-resistant sliding layer can be used as a bottom-surface layer. The heat-resistant sliding layer serves to control the sliding properties of the base on the thermal head to improve the heat resistance of the base. Examples of resins forming the heat-resistant sliding layer include cellulose resins such as ethyl cellulose, hydroxyethylcellulose, ethylhydroxy cellulose, hydroxypropyl cellulose, methylcellulose, cellulose acetate and cellulose butyrate, vinyl resins such as polyvinyl alcohol, polyvinyl acetate, polyvinyl butyral, polyvinyl acetal, polyvinyl pyrrolidone, and polyacrylamide, polyester resin, polyurethane resin, polyamide-imide resin, silicone-modified polyamide-imide resin and silicone-modified or fluorine-modified resin.

The heat-resistant sliding layer of the invention can be formed by, for example, the following method. Any of the aforementioned resins or a filler dissolved or dispersed in a suitable solvent is applied on a base to prepare a heat-resistant-sliding-layer coating dispersion. The resulting dispersion is applied by a means such as gravure printing, screen printing, or reverse roll coating using a gravure plate, and dried. The amount of the dried heat-resistant sliding layer is preferably from 0.1 to 3.0 g/m$^2$.

Examples of usable receiver sheets include natural pulp papers, coated papers, tracing papers, plastic films, metals, ceramics, wood and cloths.

EXAMPLES

The invention will hereinafter be described in greater detail with reference to the Examples, which are not intended to limit the invention.

(Method of Preparing Samples)

A heat-resistant-sliding-layer coating dispersion with the composition shown below was applied by gravure coating onto an untreated surface of a thin-film base (PET film 4WF597, a polyethylene terephthalate film, manufactured by Toray, thickness: 4.5 μm) in an amount of 0.5 g/m$^2$ as measured after drying, and dried to form a heat-resistant sliding layer. A dye-layer coating dispersion with the composition shown below was then applied by gravure coating onto the surface (which was treated to facilitate adhesion) of the thin-film base opposite to the surface with the heat-resistant sliding layer, in an amount of 0.7 g/m$^2$ as measured after drying, and dried. A thermal-transferable-protective-layer coating dispersion with the composition shown below was then applied to the dye layer in an amount of 1.0 g/m$^2$ as measured after drying, and dried to form a thermal-transferable protective layer. A sensor mark for position detection was then formed on the dye layer and thermal-transferable protective layer, so as to yield a ribbon.

| Heat-Resistant-Sliding-Layer Coating Dispersion: | |
|---|---|
| Polyamide-imide resin (HR-15ET, manufactured by Toyobo Co., Ltd.) | 50.0 parts |
| Polyamide-imide silicone resin (HR-14ET, manufactured by Toyobo Co., Ltd.) | 50.0 parts |
| Polyester resin (VYLON ® 220, manufactured by Toyobo Co., Ltd.) | 3.0 parts |
| Dye-Layer Coating Dispersion: | |
| Anthraquinone dye (C.I. Solvent Blue 63) | 3.0 parts |
| Polyvinyl butyral resin (S-LEC BX-1, manufactured by Sekisui Chemical Co., Ltd.) | 3.0 parts |
| Methyl ethyl ketone | 45.5 parts |
| Toluene | 45.5 parts |
| Thermal-Transferable-Protective-Layer Coating Dispersion: | |
| Acrylic resin (BR87, manufactured by Mitsubishi Rayon Co., Ltd.) | 20.0 parts |
| Methyl ethyl ketone | 40.0 pars |
| Toluene | 40.0 parts |

(Evaluation Method)

The ribbon prepared according to the method described above was mounted in the thermal transfer printer shown in FIG. 1, and the used ribbon was then processed. A heat roller was used as a heater. The heating temperature was 110° C.

(Results)

By using the used ribbon processing mechanism of the invention, only the dye layers were fused together. The ribbon showed no breakage.

For comparison, evaluation was also carried out in the same manner as described above, using only a second bending member with an acute top. Although the dye layers were fused together, some of the tested ribbons were partially broken, showing that stable fusion of ribbons was difficult.

The invention claimed is:

1. A thermal transfer printer comprising:

at least one printing unit for thermal transfer printing with a print head via a ribbon having a dye layer;

a width-reducing member for guiding the ribbon after thermal transfer downstream, while causing the ribbon to shrink in the width direction;

a heater disposed downstream of the width-reducing member for heating the ribbon; and a take-up roll for winding the ribbon that has passed by the heater; wherein the printing unit effects printing with the print head by moving a ribbon in a direction opposite to a downstream conveyance direction during printing; and a distance between the width-reducing member and the heater is set to be longer than a distance of movement of the ribbon during printing.

2. A thermal transfer printer comprising:

at least one printing unit for thermal transfer printing with a print head via a ribbon having a dye layer;

a width-reducing member for guiding the ribbon after thermal transfer downstream, while causing the ribbon to shrink in the width direction;

a heater disposed downstream of the width-reducing member for heating the ribbon; and a take-up roll for winding the ribbon that has passed by the heater; wherein the printing unit effects printing with the print head by moving the ribbon in a direction opposite to a downstream conveyance direction during printing; and a portion of the ribbon that passes by the heater while the ribbon is conveyed downstream is not heated by the heater within a distance of movement during printing that starts from an upstream end of the portion.

* * * * *